US005435750A

United States Patent [19]

Kosmala

[11] Patent Number: 5,435,750

[45] Date of Patent: Jul. 25, 1995

[54] BOARDLOCK

[75] Inventor: Michael L. Kosmala, Aliso Viejo, Calif.

[73] Assignee: ITT Corporation, New York, N.Y.

[21] Appl. No.: 270,697

[22] Filed: Jul. 5, 1994

[51] Int. Cl.[6] ..... H01R 13/73

[52] U.S. Cl. ..... 439/567

[58] Field of Search ..... 439/554, 557, 567, 571

[56] References Cited

U.S. PATENT DOCUMENTS

| | | | |
|---|---|---|---|
| 3,811,154 | 5/1974 | Lindeman et al. | 24/73 P |
| 3,852,849 | 12/1974 | Pestka | 24/73 P |
| 4,436,358 | 3/1984 | Coldren et al. | 439/83 |
| 4,681,389 | 7/1987 | Nakazawa et al. | 439/557 |
| 4,824,398 | 4/1989 | Taylor | 439/557 |
| 4,842,552 | 6/1989 | Frantz | 439/557 |
| 4,938,703 | 7/1990 | Nakano | 439/74 |
| 5,213,515 | 5/1993 | Ishikawa et al. | 439/79 |

OTHER PUBLICATIONS

IBM Technical Disclosure Bulletin; Board and Card Retainer; T. A. Lasky and R. J. Sonsala; vol. 17, No. 3, Aug., 1974; p. 715.

*Primary Examiner*—Gary F. Paumen
*Attorney, Agent, or Firm*—Thomas L. Peterson

[57] ABSTRACT

A boardlock is provided to hold a connector flange (20, FIG. 2) above a circuit board (14), which securely holds the flange in position. The boardlock (30) includes a body (40) with an upper portion (42) mounted on the connector flange and a lower end (44) lying above the circuit board. A pair of beams (50, 52) extend down from the body lower end to project through a circuit board hole (54) and engage a lower surface of the circuit board. A pair of standoffs (80, 82) extend down from the body lower end and abut the upper face of the circuit board. While the beam upper parts (74) can bend, the standoffs are rigid against bending and are horizontally spaced from the upper parts of the beams. A boardlock designed for machining, has beams and standoffs that are part of a form of circular shape but with a wide slot (98, FIG. 4 ) separating the form into separate beams and standoffs. A boardlock (120, FIGS. 6 and 7) designed for die casting has laterally spaced beams (134, 136) to leave an interbeam space (144) between them, with the standoffs (140, 144) lying within longitudinal extensions of the interbeam space.

6 Claims, 5 Drawing Sheets

BOARDLOCK

BACKGROUND OF THE INVENTION

Boardlocks are commonly used to secure the flanges of a connector to a circuit board. Each boardlock has a body with an upper portion secured to a connector flange, and has a pair of beams extending down from the lower end of the body to pass through a circuit board hole and resist connector pullout. A structure holds the body lower end spaced above the board so the beam upper parts can lie above the board and provide a long beam length for flexibility. U.S. Pat. No. 4,824,398 describes a boardlock as broadly described above, wherein each of the beams is provided with an enlargement that forms a shoulder to press down against the upper face of the circuit board. The enlargements hold the body lower end and the upper parts of the beam, a distance above the circuit board. However, since the upper portions of the beams must be flexible in bending, they have only limited rigidity and strength in supporting the connector flanges above the circuit board. Also, downward force on the connector is applied to only a small area immediately around a circuit board hole, which can cause board flexing. A boardlock which held a connector rigidly in position above a the circuit board, would be of value.

SUMMARY OF THE INVENTION

In accordance with one embodiment of the present invention, a boardlock is provided for holding a connector over a circuit board, which provides rigid holding of the connector. The boardlock includes a body with an upper body part for attachment to a connector and a lower body end. A plurality of beams extend down from the lower body end and through a circuit board hole to engage a lower surface of the circuit board. The body lower end is held a distance above the circuit board by a plurality of standoffs that are each horizontally spaced from the beams and that each extends down against the upper surface of the circuit board. The provision of separate standoffs enables the standoffs to be rigid against bending and to lie against a circuit board portion that is spaced appreciably from the hole in the circuit board.

A boardlock that can be constructed by machining, has standoffs that are each sections of a form having concentric circular inner and outer surfaces, as seen in a vertical sectional view. Each of the beams has a periphery that is part of a circle having the same center as the circles of the standoffs. The boardlock has a wide slot that separates ends of the standoffs and that separates the two beams.

A boardlock designed for manufacture by die casting, has laterally spaced beams, with a wide interbeam space between them. The standoffs lie within longitudinal extensions of the interbeam space.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
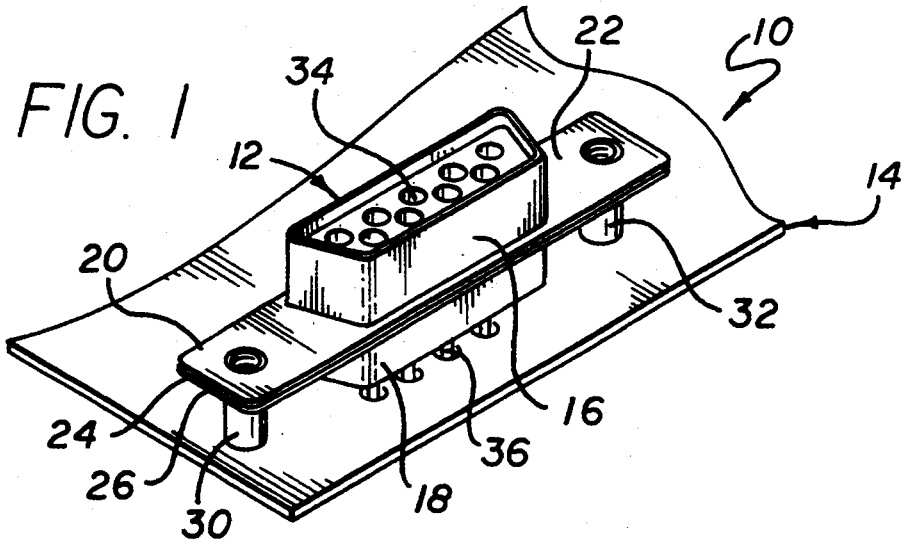
FIG. 1 is an isometric view of a connector and circuit board held together by a pair of boardlocks.
Figure 1:
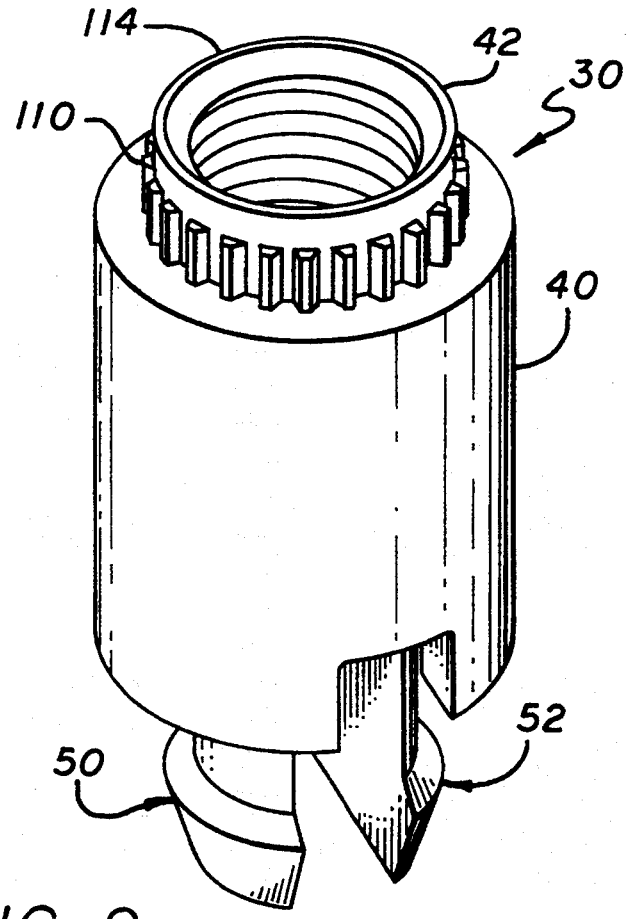
Figure 2:
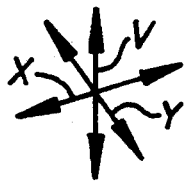
FIG. 2 is a top and side isometric view of one of the boardlocks of the assembly of FIG. 1, prior to its installation.

FIG. 1 illustrates a connector and board assembly 10 which includes an electrical connector 12 lying over a circuit board 14. The connector 12 includes a pair of shells 16, 18 with flanges 20, 22, each flange including upper and lower parts 24, 26 of the upper and lower shells. The connector is mounted to the circuit board by a pair of boardlocks 30, 32 that each keeps a corresponding flange spaced a predetermined distance from the board. The connector has several contacts 34 with lower ends that project through apertures 36 in the board to connect to traces on the board. The purpose of the boardlocks 30,32 is to hold the connector securely in position both prior to and after soldering of the contacts in place. The connector 12 may be mated with another connector at the end of a cable that may be pulled to one side, and the boardlocks are intended to resist movement of the connector that could break the solder connections.

Figure 3:
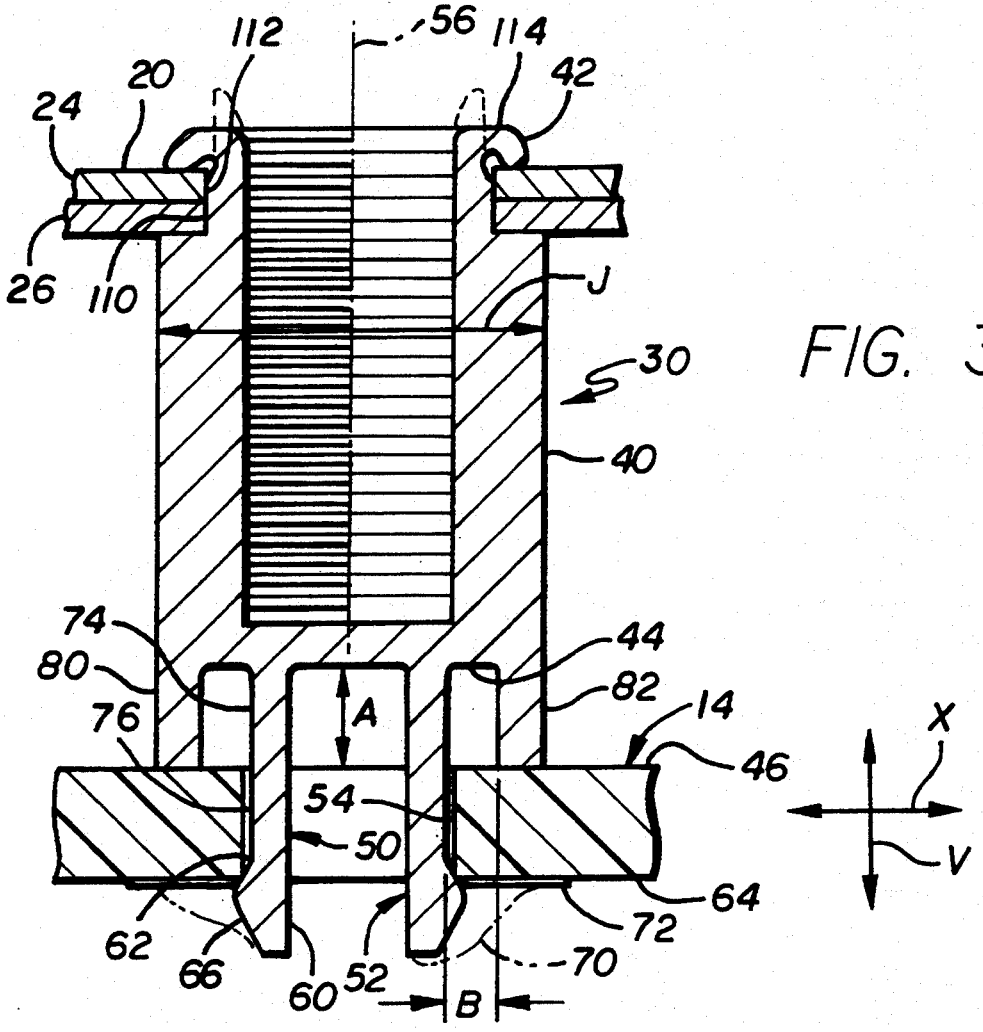
FIG. 3 is a sectional side view of one of the boardlocks and of a portion of a connector flange and of a circuit board of the assembly of FIG. 1.

FIG. 3 shows details of the first boardlock 30 which includes a body 40 having an upper part 42 attached to a connector flange 20. The body has a lower end 44 spaced a distance A from an upper face 46 of the circuit board 14. A pair of beams 50, 52 extend downwardly from the body lower part 44 through a round hole 54 in the board. The beams 50, 52 lie on laterally opposite sides of the vertical boardlock axis 56. Arrows X indicate a lateral direction while arrows Y indicate a perpendicular longitudinal direction, both being perpendicular to the vertical direction V. Each beam has a lower part 60 with a downwardly-outwardly inclined surface 62 (outwardly with respect to the axis 56) that engages the circuit board lower face 64 at the walls of the hole, to prevent upward movement of the boardlock out of the hole. The beam lower parts also have downwardly-inwardly inclined surfaces 66 which deflect the beams together as they are inserted into the board hole. It is noted that after installation, the beam lower parts 60 may be soldered by solder fillets 70 to a conductive trace 72 on the board lower face.

Each beam such as 50 has an individually bendable upper part 74 which extends by the distance A above the circuit board. The distance A is required to provide considerable resilience in the beams so they can deflect together to enter the board hole and then press outwardly against the bottom face of the board. Middle beam parts 76 which lie within the board, also add resilience.

The body lower end 44 from which the beams depend, is held at the distance A above the board by a pair of standoffs 80, 82. Applicant constructs the standoffs 80, 82 so they are separate from the beams and are spaced by a distance B from the beams. The standoffs 80, 82 are rigid so their lower ends 84, 86 do not shift. The spacing of the standoffs from the beam upper parts 74 results in the standoffs not affecting resilience of the beams. The standoffs are rigid to prevent downward movement of the boardlock and connector flanges. The standoffs preferably also resist tipping of the connector relative to the circuit board, to resist breaking of solder connections.

Figure 4:
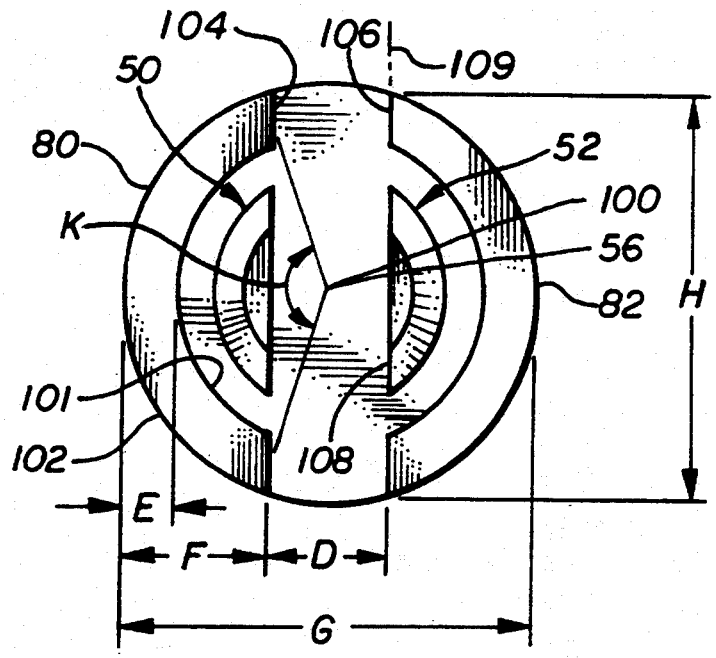
FIG. 4 is a bottom view of the boardlock of FIG. 2.
Figure 5:
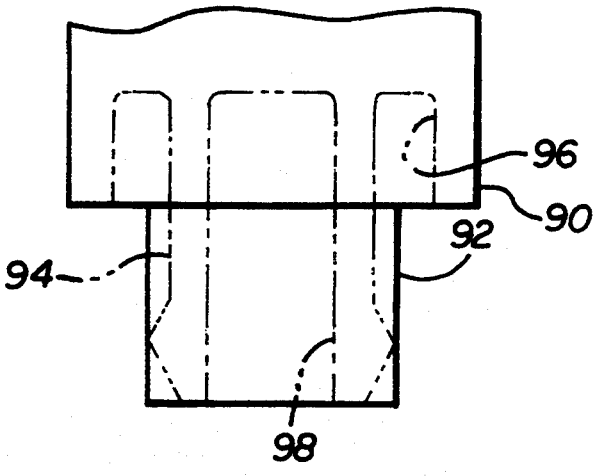
FIG. 5 is a side elevation view of a workpiece, showing how it can be machined to form the boardlock of FIG. 3.

The boardlock is constructed to it can be machined from a piece of metal such as stainless steel or brass. To construct the boardlock, a rod of metal is first machined as shown in solid lines in FIG. 5 to form portions 90, 92. The portion 92 is further machined to the contour shown at 94 with a groove 96 machined in the rod, to form standoffs and beam precursors, respectively, at 90 and 92. Finally, a saw is used to cut across the workpiece to form a wide slot 98. A bottom view of the resulting boardlock is shown in FIG. 4. The beams 50, 52 are spaced apart by a distance D, as are the standoffs 80, 82. The standoff has a moderate radial thickness E (with respect to a circle center 100 which is coincident with the boardlock axis 56). The standoffs are each a section of a form having circular inner and outer surfaces 101,102, and having adjacent section ends 104, 106 that face each other. The beam inner faces 108 lie on the same imaginary lines 109 as the standoff section ends.

Each standoff has a standoff rigidity thickness, or lateral width F, which is at least twice its radial thickness E. The width F is a primary determinant of the rigidity of the standoff against bending. The standoffs have a large footprint, in that there is a large distance G between laterally opposite edges of the boardlock and almost as large a distance H between longitudinally spaced opposite edges of the boardlock. This large footprint helps the boardlock avoid tipping of the connector. Also, the large footprint of the pair of standoffs results in their bearing against areas of the circuit board that are spaced from the hole. These circuit board areas are not weakened by the hole and are widely spaced, so they are more rigid than board areas adjacent to the hole.

The upper part 42 of the boardlock can be fastened to the flange 20 in many ways. One way shown is to provide a knurl 110, with a hole 112 in the flange being aligned with the knurl and the knurl being forced into interference fit with the walls of the flange hole. Then a thin top 114 of the body upper part is bent over to press down against the flange.

Applicant has designed a boardlock of the construction shown in FIGS. 1–4, with a body diameter J (FIG. 3) of 0.22 inch. The slot 98 (FIG. 4) had a width D of 0.07 inch. This results in each standoff such as 80 subtending an angle K of about 140°, resulting in a longitudinal footprint distance H almost as great as the lateral footprint distance G. The other dimensions of the boardlock are in the proportions illustrated in FIGS. 3 and 4.

Figure 6:
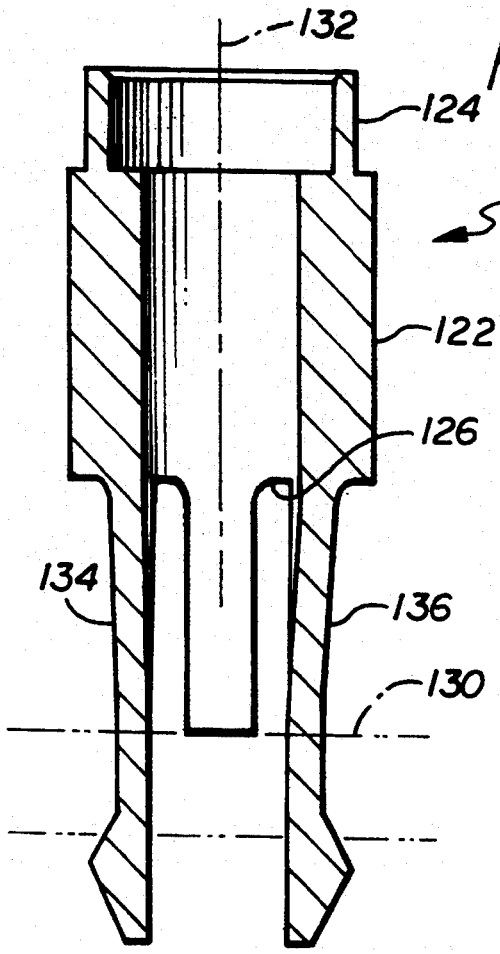
FIG. 6 is a sectional view of a boardlock constructed in accordance with another embodiment of the invention, and adapted for manufacture by die casting.
Figure 7:
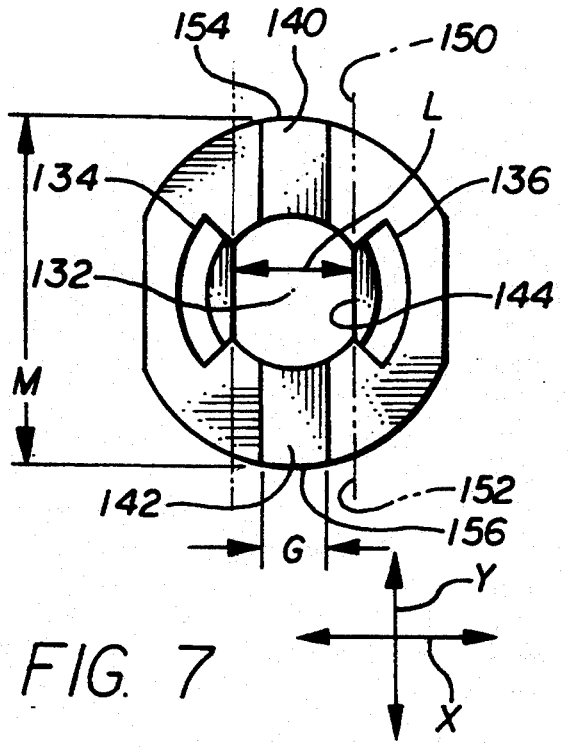
FIG. 7 is a bottom view of the boardlock of FIG. 6.

FIGS. 6 and 7 illustrate another boardlock 120 which is designed so it can be manufactured by a molding process such as die casting. The boardlock includes a body 122 with an upper part 124 for attaching to a connector such as to the flange thereof, and with a body lower end 126 designed to lie a distance above a circuit board indicated at 130. The boardlock has a vertical axis 132 and has a pair of beams 134, 136 on opposite sides of the axis. As shown in FIG. 7, the boardlock has a pair of standoffs 140, 142 that also lie on opposite sides of the axis 132. However, the boardlocks lie in positions rotated 90° from the positions of the beams. The beams are separated by a lateral beam spacing L, to leave an interbeam space 144 between the beams. The standoffs 140, 142 lie within the boundaries of imaginary longitudinal extensions 150, 152 of the interbeam space 144. This construction facilitates molding, such as die casting, of the boardlock. The standoffs have outer edges 154, 156 that are spaced apart by a distance M that is much greater than radially outer portions of the beams.

Figure 9:
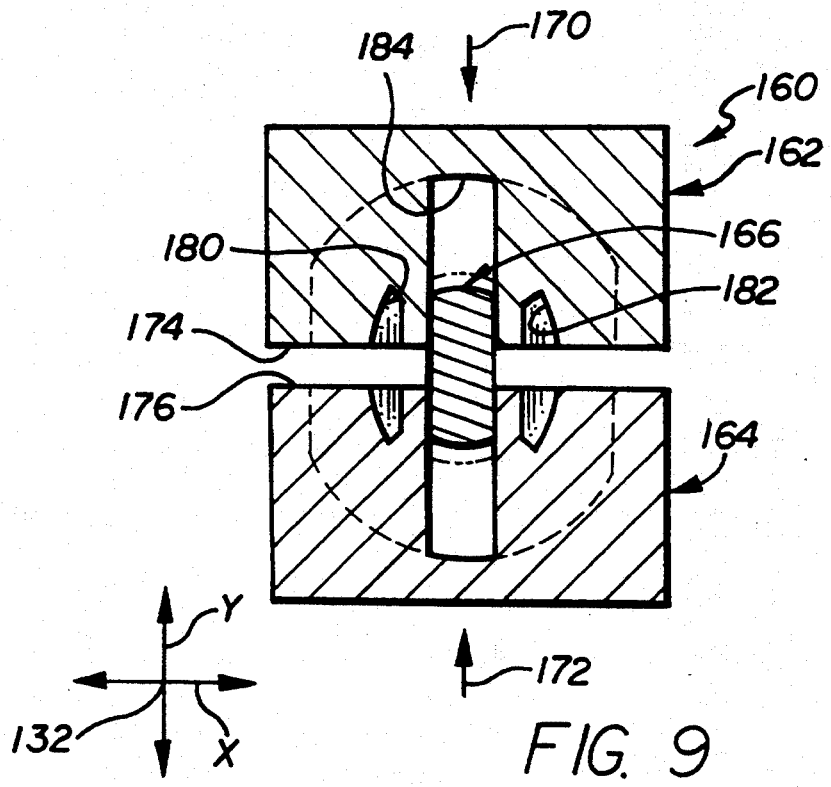
FIG. 9 is a sectional vertical view of die parts used to manufacture the boardlock of FIG. 6, with one of the elements being taken on the line 9—9 of FIG. 8.
Figure 8:
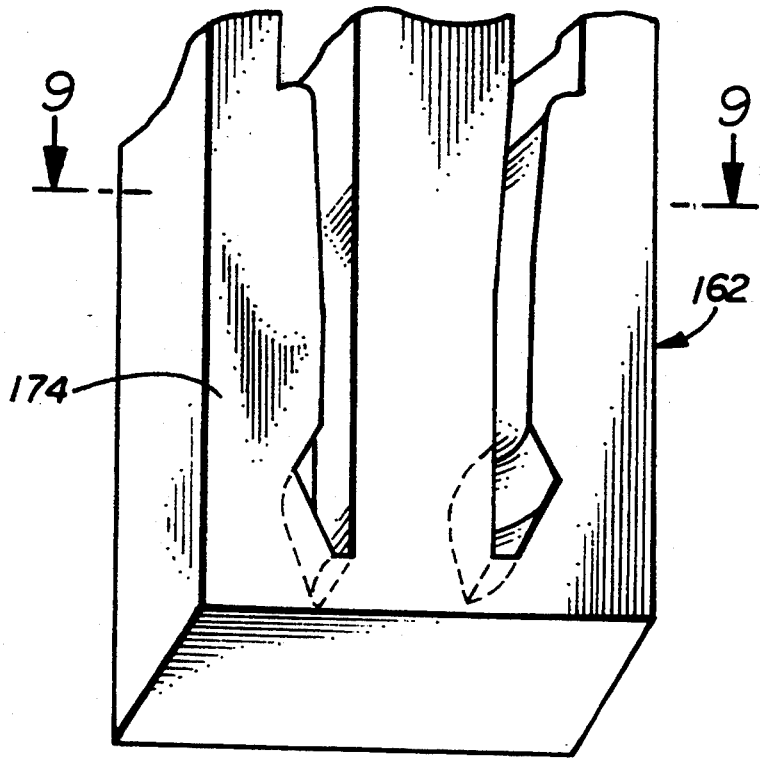
FIG. 8 is a partial isometric view of a die part used in the manufacture of the boardlock of FIG. 6.

FIG. 9 shows a vertical sectional view of a die casting mold 160 which includes identical first and second mold parts 162, 164 and a different third mold part 166. The mold parts are shown separated, and the first and second mold parts are moved together as indicated by arrows 170, 172 until the faces 174, 176 of the first and second mold parts abut one another. Then molding or casting materials such as a zinc alloy is poured into the mold to form the beams and standoffs. Finally, the first and second mold parts 162, 164 are moved apart so the lower half of the boardlock can be removed from the mold. It can be seen that each mold part such as 162 has a pair of cavities 180, 182 that each forms half of a beam, and also has a cavity 184 that forms a standoff in conjunction with the third mold part 166.

Although terms such as "vertical", "horizontal", etc. have been used herein to describe the relative orientation of the parts and to aid in understanding the drawings, it should be understood that the boardlock and other parts can be used in any orientation with respect to gravity.

Thus, the invention provides a boardlock for holding a connector to a circuit board, which provides enhanced stability of connector position with respect to the circuit board. The boardlock includes a plurality of beams with upper parts extending above the circuit board to the lower end of a boardlock body. The body is held so its lower end is above the circuit board, by a plurality of standoffs that are spaced from the upper part of the beams and that extends from the body down to the circuit board to engage the upper surface of the circuit board. The standoffs are rigid and their radially outer edges are spaced apart by much more than the radially outer parts of the beams. In one connector that can be manufactured by machining, the boardlocks have circular inside and outside surfaces that subtend an angle of much more than 90° and lie beyond corresponding beams. In another boardlock designed for die casting, a pair of boardlocks are positioned at angles rotated 90° from the positions of a pair of beams; also, the standoffs lie within imaginary longitudinal extensions of the interbeam space across which the beams are laterally spaced.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. Apparatus for reception in a hole of a connector flange and in a hole of a circuit board that has upper and lower board faces, to hold the flange at a location spaced a predetermined distance above the board upper face, which includes an integral boardlock having a body with an upper body part constructed for reception in the flange hole and with a body lower end, wherein said boardlock has a plurality of deflectable beams each extending down from said body lower end for projection through said board hole, said beams each having an individually bendable upper part for lying above said board and a lower part constructed to engage the board lower surface at said hole, said boardlock having a plurality of standoffs positioned to abut the circuit board upper face and hold said bendable beam upper parts above said board, characterized by:

said standoffs each extend down from said body lower end and are each rigid against bending that would shift its lower end horizontally, with each standoff being horizontally spaced from said beam upper parts.

2. The apparatus described in claim 1 including said connector and said circuit board, and wherein:

said body upper part lies in and is fixed in place in said hole in said flange, said standoff portions have lower ends that abut said circuit board upper face, and said beams project through said board hole.

3. The apparatus described in claim 1 wherein:

as seen in a bottom view of said boardlock, said plurality of standoffs each comprise separated sections of a single form that has circular inner and outer surfaces with section ends that face each other.

4. The apparatus described in claim 3 wherein:

said circular outer surface has a circle center, each of said standoffs extend more than 90° about said circle axis, and each of said standoffs has a standoff rigidity thickness F, as measured by the radial distance between the center and ends of a section, which is at least twice the radial thickness E between the inside and outside surfaces of said standoff.

5. The apparatus described in claim 1 wherein said boardlock is constructed to facilitate manufacture by casting, and wherein:

as seen in a bottom view, said plurality of beams includes two beams that are laterally spaced apart by a predetermined beam spacing to leave an interbeam space between them;

said plurality of standoffs includes two standoffs, each having a laterally-extending width that is less than said beam spacing, and said boardlocks are positioned to lie in an imaginary longitudinal extension of said interbeam space.

6. Apparatus for mounting a connector so it lies a distance above a circuit board, comprising:

a boardlock having a body with a lower end, a pair of beams extending down from said body lower end, and a pair of standoffs extending down from said body lower end by a distance less than said beams;

said standoffs are each sections of a hollow form that has circular inner and outer surfaces and opposite section ends, as seen in a bottom view, with said inner and outer surfaces having a coincident circle center;

each of said beams has a circular outer surface centered on said circle center and has flat inner surfaces;

the opposite section ends of each of said standoffs lies on an imaginary longitudinally extending line, and the flat inner surface of one of said beams lies on the same longitudinally extending line.

* * * * *